US008087664B2

(12) United States Patent
Imai

(10) Patent No.: US 8,087,664 B2
(45) Date of Patent: Jan. 3, 2012

(54) SHEET FEEDING APPARATUS AND IMAGE FORMING APPARATUS

(75) Inventor: Yusuke Imai, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 51 days.

(21) Appl. No.: 12/493,217

(22) Filed: Jun. 28, 2009

(65) Prior Publication Data

US 2009/0322014 A1 Dec. 31, 2009

(30) Foreign Application Priority Data

Jun. 30, 2008 (JP) ..... 2008-171715

(51) Int. Cl.
*B65H 1/00* (2006.01)

(52) U.S. Cl. ..... 271/171

(58) Field of Classification Search ..... 271/171; 399/393

See application file for complete search history.

(56) References Cited

U.S. PATENT DOCUMENTS 6,267,522 B1 * 7/2001 Slippy et al. ..... 400/708.1
2008/0001346 A1 * 1/2008 Meetze et al. ..... 271/171
2009/0322014 A1 * 12/2009 Imai ..... 271/110

FOREIGN PATENT DOCUMENTS

JP 2002-255358 A 9/2002

* cited by examiner

*Primary Examiner* — Michael McCullough
(74) *Attorney, Agent, or Firm* — Canon U.S.A., Inc. IP Division

(57) ABSTRACT

An apparatus includes a housing unit in which sheets are stacked, and a regulator in the housing unit including a body that has surfaces at which ends of the sheets are regulated. The apparatus further includes a stopper in the regulator, a retainer in the housing unit configured to engage with the stopper to lock the regulator to the housing unit, and a movement mechanism configured to move, when the body is pushed in a direction in which the regulator is to be moved, the stopper away from the retainer to disengage the stopper from the retainer.

8 Claims, 7 Drawing Sheets

--Prior Art--

--Prior Art--

--Prior Art--

SHEET FEEDING APPARATUS AND IMAGE FORMING APPARATUS

BACKGROUND OF THE INVENTION

1. Field of the Invention

The present invention relates to sheet feeding apparatuses configured to feed sheets and image forming apparatuses, such as a copier, a facsimile (FAX), a printer, and a multi-function machine, that include the sheet feeding apparatuses.

2. Description of the Related Art

Sheet feeding cassettes in which sheets to be used in image forming apparatuses are housed typically have sheet-end-regulating mechanisms configured to regulate the ends of the sheets, such as side regulators configured to regulate the widthwise ends of the sheets housed in the cassettes and trailing-end regulators configured to regulate the upstream ends of the sheets in a sheet conveyance direction.

Such a sheet-end-regulating mechanism is movably disposed on a cassette frame of the sheet feeding cassette, and includes a locking/releasing mechanism with which the sheet-end-regulating mechanism is locked to and released from the cassette frame. Thus, the position of the sheet-end-regulating mechanism can be changed and fixed in accordance with the size of sheets that a user desires to supply to the cassette. An example of such a technique is disclosed in Japanese Patent Laid-Open No. 2002-255358.

FIG. 7 shows an exemplary sheet-end-regulating mechanism. A trailing-end regulator 2, serving as the sheet-end-regulating mechanism, will now be described.

The trailing-end regulator 2 has a regulating surface 2*a* at which the trailing ends of sheets are regulated, a rear plate 4 on the side opposite the regulating surface 2*a*, and projections 3 at the bottom. The projections 3 slidably engage with rails provided in a cassette frame (not shown), whereby the trailing-end regulator 2 is movable in a sheet feed direction. The trailing-end regulator 2 also has a stopper 6 integrally provided thereon and with which the trailing-end regulator 2 is locked to the cassette frame. The stopper 6 is turnably supported by the rear plate 4 with an elastic rib 8 interposed therebetween. The stopper 6 includes a release lever 7 handled by a user, and a locking projection 9 engageable with a rack provided on the cassette frame, the rack extending in a direction in which the trailing-end regulator 2 moves.

To move the trailing-end regulator 2, the user pinches the release lever 7 of the stopper 6 and the rear plate 4 of the trailing-end regulator 2 together, whereby the elastic rib 8 bends and the stopper 6 turns. This disengages the locking projection 9 from the rack (not shown) of the cassette frame, allowing the trailing-end regulator 2 to move.

In such an operation of moving the trailing-end regulator 2, however, the release lever 7 and the rear plate 4 are to be kept pinched together with a plurality of fingers.

Even if it is attempted to push the trailing-end regulator 2 at the rear plate 4 from the left side in FIG. 7 so as to avoid pinching with fingers, a large physical force is used to move the trailing-end regulator 2, resulting in poor operability.

SUMMARY OF THE INVENTION

According to an aspect of the present invention, a sheet feeding apparatus includes a housing unit in which sheets are stacked, a regulator in the housing unit including a body having a surface at which ends of the sheets in the housing unit are regulated, a stopper in the regulator, a retainer in the housing unit configured to engage with the stopper to lock the regulator to the housing unit, and a movement mechanism configured to move, when the body is pushed in a direction in which the regulator is to be moved, the stopper away from the retainer to disengage the stopper from the retainer.

Further features of the present invention will become apparent from the following description of exemplary embodiments with reference to the attached drawings.

DESCRIPTION OF THE EMBODIMENTS

Figure 1:
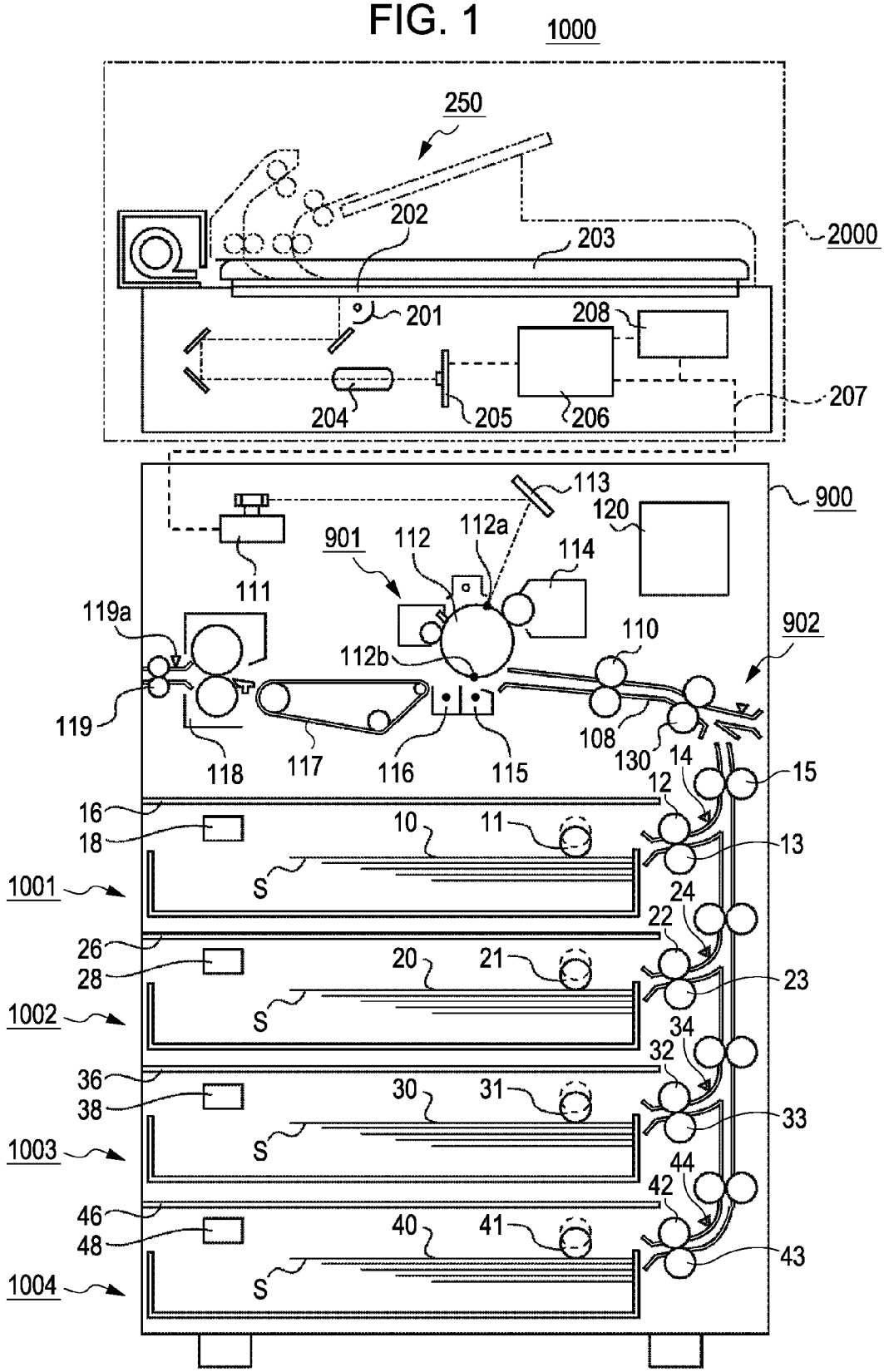
FIG. 1 is a cross-sectional view of a printer, an exemplary image forming apparatus, that includes a sheet feeding apparatus according to an embodiment of the present invention.

Embodiments of the present invention will now be described in detail with reference to the drawings. FIG. 1 is a cross-sectional view of a printer, an exemplary image forming apparatus, that includes a sheet feeding apparatus according to an embodiment of the present invention.

Referring to FIG. 1, a printer 1000 includes a printer body 900 configured to form an image on a sheet, and a scanner 2000 disposed on the top of the printer body 900 and configured to read a document. The scanner 2000 includes a scanning-optical-system light source 201, a platen glass 202, an openable/closable document pressing plate 203, a lens 204, a photodetector 205, an image processing unit 206, a memory unit 208 in which image processing signals processed by the image processing unit 206 are stored, and so forth.

When the scanner 2000 reads a document, light is applied from the scanning-optical-system light source 201 to the document (not shown) placed on the platen glass 202. The read image of the document is processed by the image processing unit 206, is converted into an electrical signal 207, which is an electrically encoded signal, and is sent to a laser scanner 111, which serves as an imaging unit. If necessary, image information encoded and processed by the image processing unit 206 may be temporarily stored in the memory unit 208 and be subsequently sent to the laser scanner 111 in accordance with a signal from a controller 120 described below.

The printer body 900 includes an image forming unit 901, sheet feeding apparatuses 1001 to 1004 configured to feed sheets S, a sheet conveying device 902 configured to convey to the image forming unit 901 each of the sheets S fed from the sheet feeding apparatuses 1001 to 1004, and the controller 120 serving as a control unit configured to control the printer 1000.

The image forming unit 901 includes a photosensitive drum 112, the laser scanner 111, a developer 114, a transfer charger 115, a detach charger 116, and so forth. To form an image, laser light from the laser scanner 111 is redirected by a mirror 113 and is applied to an exposure position 112*a* on the photosensitive drum 112 that is rotating clockwise, whereby a latent image is formed on the photosensitive drum 112. The latent image formed on the photosensitive drum 112 is developed as a toner image by the developer 114.

The toner image formed on the photosensitive drum 112 is subsequently transferred onto the sheet S at a transfer position 112*b* by the transfer-charger 115. The sheet S having the toner image is electrostatically detached from the photosensitive drum 112 by the detach charger 116, is conveyed by a conveyor belt 117 to a fixing device 118 for fixation of the toner image, and is then discharged by a discharge roller 119. A sheet discharge sensor 119*a* is disposed at a position on a conveyance path between the fixing device 118 and the discharge roller 119. The passage of the sheet S that is discharged is detected by the sheet discharge sensor 119*a*.

The sheet feeding apparatuses 1001 to 1004 configured to feed sheets to the image forming unit 901 are provided below the image forming unit 901, and the configurations thereof are the same. Therefore, the sheet feeding apparatus 1001 will now be representatively described.

The sheet feeding apparatus 1001 includes a sheet feeding cassette 10, a pickup roller 11, and a separator constituted by a feed roller 12 and a retarding roller 13. Sheets S housed in the sheet feeding cassette 10 are separated and fed one by one by the pickup roller 11, which is lifted and rotated with predetermined timings, and the separator. The sheet feeding apparatus 1001 also includes a sheet feed sensor 14 near the downstream end thereof in a sheet conveyance direction with respect to the feed roller 12 and the retarding roller 13. The sheet feed sensor 14 detects the passage of the sheet S.

Likewise, the sheet feeding apparatuses 1002 to 1004 include sheet feeding cassettes 20, 30, and 40, pickup rollers 21, 31, and 41, feed rollers 22, 32, and 42, retarding rollers 23, 33, 43, and sheet feed sensors 24, 34, and 44, respectively.

In FIG. 1, a space in which the sheet feeding apparatuses 1001 to 1004 are arranged are partitioned by partitions 16, 26, 36, and 46. The environment (temperature and humidity) in the space is detected by environmental sensors 18, 28, 38, and 48.

The sheet conveying device 902 includes a pair of conveyor rollers 15 and a registration roller unit constituted by a pair of pre-registration rollers 130 and a pair of registration rollers 110. The sheet S fed from any of the sheet feeding apparatuses 1001 to 1004 is conveyed by the pair of conveyor rollers 15 and is guided through a sheet conveyance path 108, constituted by a guide plate, to the pair of registration rollers 110. Subsequently, the sheet S is conveyed by the pair of registration rollers 110 to the image forming unit 901.

The printer body 900 and the scanner 2000, which are provided as separate bodies in this embodiment, may alternatively be provided as an integral body. In either case, the printer body 900 functions as a copier if a processing signal from the scanner 2000 is input to the laser scanner 111, as a FAX if a send signal from another FAX is input to the laser scanner 111, and as a printer if an output signal from a personal computer is input to the laser scanner 111.

The printer body 900 also functions as a FAX if a processing signal from the image processing unit 206 of the scanner 2000 is sent to another FAX. In addition, if the scanner 2000 includes an automatic document feeder 250, shown by two-dot chain lines, instead of the document pressing plate 203, a document can be read automatically.

The sheet feeding cassette will now be described. As mentioned above, the sheet feeding apparatuses 1001 to 1004 of this embodiment have the same configuration. That is, the sheet feeding cassettes 10, 20, 30, and 40 also have the same configuration. Therefore, the sheet feeding cassette 10 will only be described with reference to FIGS. 2A to 2C.

Figure 2A:
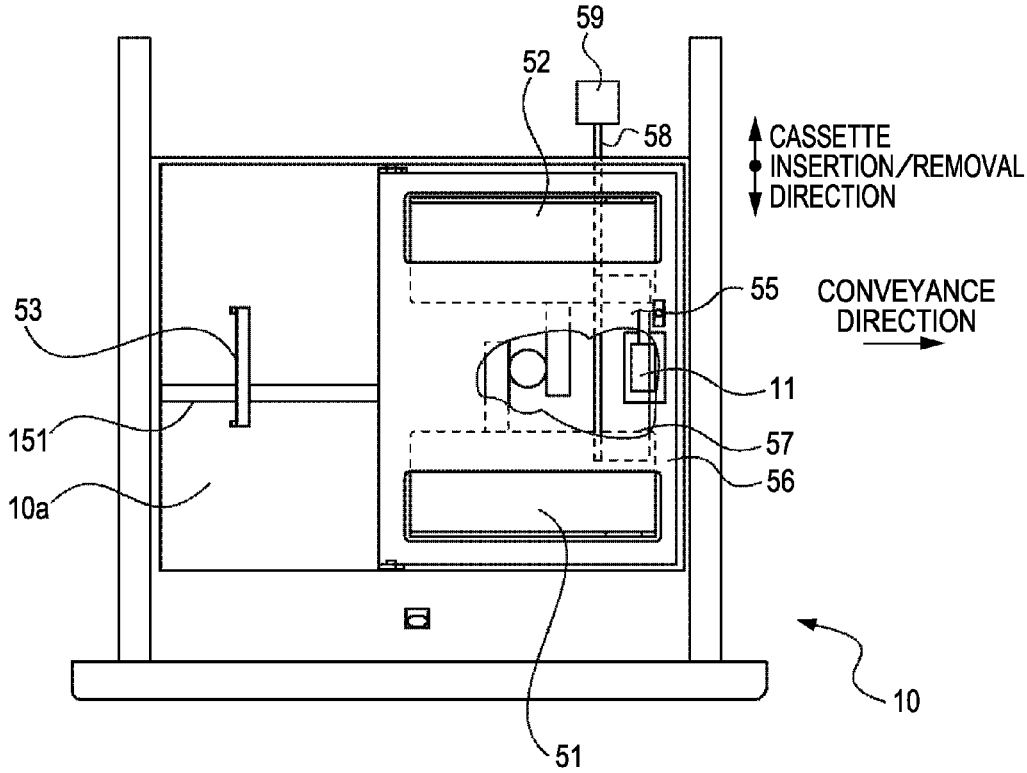
FIGS. 2A, 2B, and 2C are a plan view, a principal cross-sectional view, and an enlarged partial view, respectively, of a sheet feeding cassette included in the sheet feeding apparatus shown in FIG. 1.
Figure 2B:
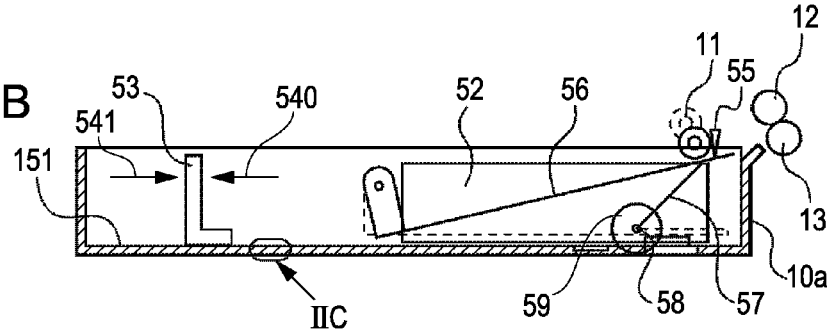

FIG. 2A is a plan view of the sheet feeding cassette 10. FIG. 2B is a principal cross-sectional view of the sheet feeding cassette 10. In this embodiment, the sheet feeding cassette 10 is inserted into and removed from a cassette housing, provided in the printer body 900, in a direction orthogonal to the sheet conveyance direction.

Referring to FIG. 2A, side-regulating plates 51 and 52 serve as sheet regulators that regulate the respective widthwise ends of sheets S stacked in the sheet feeding cassette 10. The side-regulating plates 51 and 52 are provided on a cassette frame 10*a* of the sheet feeding cassette 10 and are movable in a sheet width direction so as to match the size of the sheets S. A trailing-end regulator 53 serves as another sheet regulator that regulates the trailing ends of the sheets S in the sheet conveyance direction. The trailing-end regulator 53 is provided on the cassette frame 10*a* of the sheet feeding cassette 10 and are movable in the sheet conveyance direction so as to match the size of the sheets S.

The sheet feeding cassette 10 can be drawn from the printer body 900 along cassette rails (not shown). A user can supply sheets S into the sheet feeding cassette 10 by pulling the sheet feeding cassette 10 from the printer body 900. When the sheet feeding cassette 10 is fully inserted into the cassette housing, the sheet feeding cassette 10 is detected by a cassette insertion/removal sensor (not shown). The cassette insertion/removal sensor sends a detection signal to the controller 120. In accordance with the detection signal from the cassette insertion/removal sensor, the controller 120 determines whether the sheet feeding cassette 10 is set in the cassette housing or out of the cassette housing.

Referring to FIG. 2B, the sheet feeding cassette 10 has thereinside a sheet supporting plate 56 movable up and down and serving as a sheet supporter on which sheets S are stacked, and a lifter plate 57 provided below the sheet supporting plate 56 and configured to move the sheet supporting plate 56 up and down. The lifter plate 57 is secured to a lifter-moving shaft 58 and turns with a driving force transmitted from a lifter-moving gear 59 provided on the lifter-moving shaft 58.

When the sheet feeding cassette 10 is fully inserted into the printer body 900, a driving force is transmitted from a drive source (not shown) to the lifter-moving gear 59, causing the lifter plate 57 to turn counterclockwise in FIG. 2B and the sheet supporting plate 56, which is in contact with the lifter plate 57, to also turn counterclockwise, whereby the sheet supporting plate 56 is lifted. When the sheet feeding cassette 10 is removed from the printer body 900, the transmission of the driving force to the lifter-moving gear 59 is stopped, and the lifter plate 57 and the sheet supporting plate 56 turn clockwise in FIG. 2B because of their own weights and the weight of the sheets S stacked thereon, whereby the sheet supporting plate 56 is lowered. In this manner, the sheet supporting plate 56 is lifted and lowered with the insertion and removal of the sheet feeding cassette 10.

The sheet feeding cassette 10 has at an upper position thereof a top-position detection sensor 55 with which whether the top of the stack of sheets S on the sheet supporting plate 56 is at an appropriate height for sheet feeding is checked. When the sheet feeding cassette 10 is fully inserted into the printer body 900, the sheet supporting plate 56 starts to be lifted. When the top-position detection sensor 55 detects the top of the stack of sheets S, the lifting of the sheet supporting plate 56 is stopped, whereby the top of the stack of sheets S is held at the appropriate height. When the sheets S are sequentially fed from the top and the top position of the stack of sheets S is lowered, the top-position detection sensor 55 is turned off. In response to this, the sheet supporting plate 56 is lifted. Such operations are realized by the controller 120 controlling the drive source (not shown). In this manner, it is controlled that the top of the stack of sheets S be held within a predetermined range.

Figure 3A:
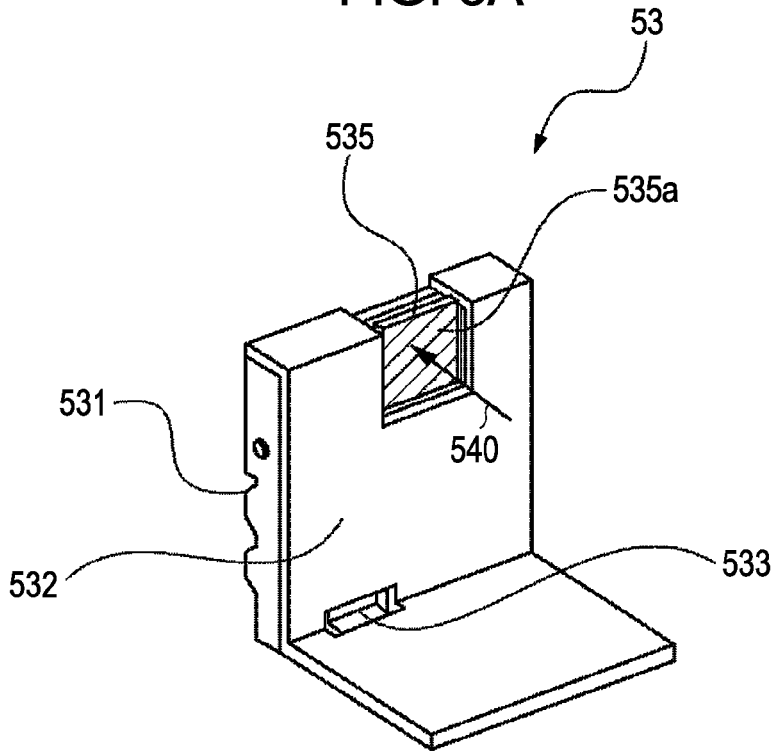
FIGS. 3A and 3B are a perspective views and an internal perspective view, respectively, of a trailing-end regulator provided in the sheet feeding cassette shown in FIGS. 2A to 2C.
Figure 3B:
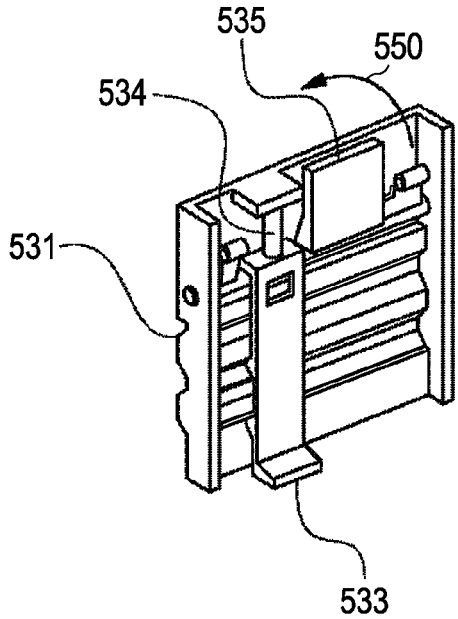
Figure 4A:
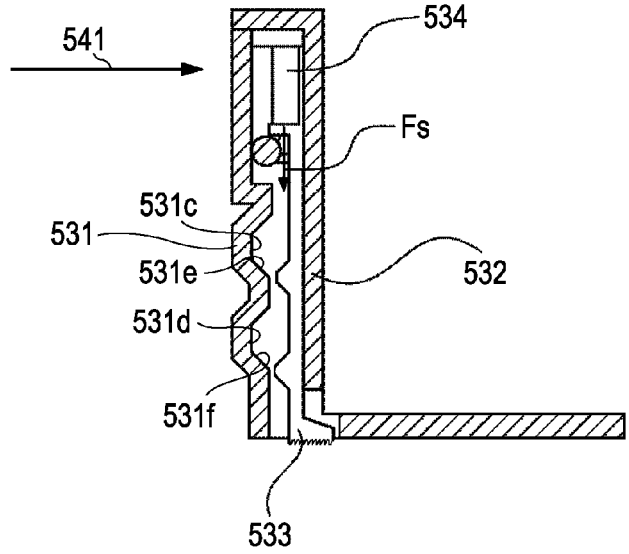
FIGS. 4A and 4B are a cross-sectional view and a cross-sectional partial view of the trailing-end regulator shown in FIGS. 3A and 3B.
Figure 4B:
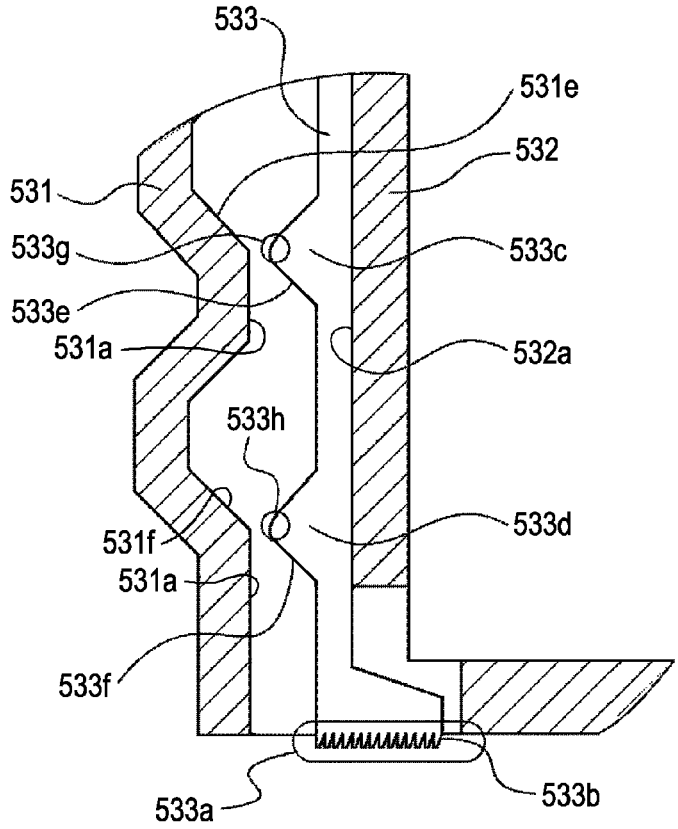

Referring to FIGS. 3A to 4B, the trailing-end regulator 53, to which the present invention is applied, will now be described in detail. FIG. 3A is a perspective view of the trailing-end regulator 53. FIG. 3B is another perspective view of the trailing-end regulator 53, with a regulating plate 532 thereof removed for easy understanding of the internal configuration. FIG. 4A is a cross-sectional view showing the entirety of the trailing-end regulator 53. FIG. 4B is an enlarged cross-sectional view showing a rack 533*a* of a stopper 533 and relevant elements provided therearound.

The trailing-end regulator 53 includes the regulating plate 532 to be in contact with the sheets S, the stopper 533, a spring 534, a release lever 535 with which the stopper 533 is moved, and a case 531 retaining the foregoing elements. The stopper 533 is disposed inside a regulator body constituted by the regulating plate 532 and the case 531, and locks the trailing-end regulator 53 inside the sheet feeding cassette 10. The stopper 533, enclosed by the case 531 and the regulating plate 532 constituting the regulator body, is configured to be slidably in contact with a contact surface 532*a* of the regulating plate 532, the contact surface 532*a* serving as a guide surface provided on the inner side of the regulating plate 532. The stopper 533 has projections 533*c* and 533*d* on a side thereof facing the case 531. The projections 533*c* and 533*d* are configured to be slidably in contact with contact surfaces 531*a* of the case 531, the contact surfaces 531*a* also serving as guide surfaces. Thus, the stopper 533 is movable up and down inside the regulator body by being guided along the contact surface 532*a* and the contact surfaces 531*a*.

The stopper 533 is connected at the top thereof to the release lever 535, which is turnably supported by the case 531, and is urged by the spring 534, provided on the top thereof, in a downward direction with a force Fs. The stopper 533 has at the bottom thereof the rack 533*a*. The teeth of the rack 533*a* have surfaces 533*b* thereof, on the leading sides in the sheet conveyance direction (the right sides of the teeth in FIG. 4B), sloping at a predetermined angle with respect to the vertical direction.

The release lever 535 and the stopper 533 are connected to each other with a link mechanism. When the release lever 535 is turned against the resilience of the spring 534, the stopper 533 is lifted up along the contact surface 532*a*.

Figure 2C:
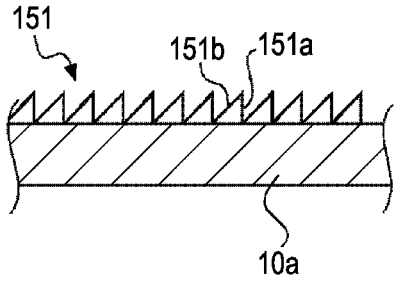

Referring to FIG. 2A, the cassette frame 10*a* of the sheet feeding cassette 10 has a rack 151, serving as a retainer, with which the rack 533*a* of the stopper 533 can mesh so that the trailing-end regulator 53 is locked to the cassette frame 10*a*. Referring to FIG. 2C, the teeth of the rack 151 have surfaces 151*a* thereof, on the leading side in the sheet conveyance direction, extending in the vertical direction, and surfaces 151*b* thereof, on the side opposite the surfaces 151*a*, sloping at an angle substantially the same as the angle at which the surfaces 533*b* of the rack 533*a* of the stopper 533 slope.

The rack 533*a* of the stopper 533 is urged by the spring 534 in a direction toward the rack 151 of the sheet feeding cassette 10. This causes the rack 533*a* to mesh with the rack 151, whereby the trailing-end regulator 53 is locked to the sheet feeding cassette 10. To unlock the trailing-end regulator 53, the release lever 535, serving as a lock releaser, is turned in the direction indicated by an arrow 550 shown in FIG. 3B so that the stopper 533 is lifted up, whereby the rack 533*a* is moved away from the rack 151.

Now, a method of moving the trailing-end regulator 53 will be described.

Typically, to move the trailing-end regulator 53, the trailing-end regulator 53 is first unlocked by moving the rack 533*a* of the stopper 533 away from the rack 151 of the sheet feeding cassette 10. In the typical unlocking method, the rear side of the case 531 and the release lever 535 are pinched together with fingers. Accordingly, the release lever 535 turns in the direction of the arrow 550, and the stopper 533 is released. While the trailing-end regulator 53 is unlocked, the trailing-end regulator 53 can be moved in the sheet conveyance direction and the direction opposite thereto to a given position where the trailing ends of the sheets S are to be regulated by the trailing-end regulator 53.

Next, a method, different from the typical method, used in moving the trailing-end regulator 53 in the direction (a direction indicated by an arrow 540 in FIG. 2B) opposite to the conveyance direction will be described. Referring to FIGS. 3A and 3B, when a handling surface 535*a* of the release lever 535 is pushed in the direction of the arrow 540, the release lever 535 turns in the direction of the arrow 550, whereby the stopper 533 is disengaged from the rack 151 of the cassette frame 10*a*. If the handling surface 535*a* of the release lever 535 continues to be pushed, the trailing-end regulator 53 moves. That is, the trailing-end regulator 53 can be moved in the direction (the direction of the arrow 540 in FIG. 2B) opposite to the conveyance direction not only by the above-described typical method but also by continuous pushing of the handling surface 535*a* of the release lever 535, without the pinching action.

Now, another method, according to the embodiment of the present invention, used in moving the trailing-end regulator 53 in the sheet conveyance direction (a direction indicated by an arrow 541 shown in FIG. 2B) will be described. This method also differs from the typical method of pinching the release lever 535.

In the typical method and the foregoing method of moving the trailing-end regulator 53 in the direction (the direction of the arrow 540) opposite to the sheet conveyance direction, the trailing-end regulator 53 is moved by using the release lever 535 so as to release the stopper 533. In terms of improvement in operability, however, it is desired that the trailing-end regulator 53 be movable in the sheet conveyance direction (the direction of the arrow 541 in FIG. 2B) only by being pushed in the direction in which the trailing-end regulator 53 is to be moved, without the pinching of the release lever 535. Now, a configuration will be proposed in which the trailing-end regulator 53 can be moved in the sheet conveyance direction (the direction of the arrow 541) with a small physical force even without the use of the release lever 535.

Referring to FIGS. 4A and 4B, in the trailing-end regulator 53, the stopper 533 is configured to be slidably in contact with the contact surface 532*a* of the regulating plate 532 and the contact surfaces 531*a* of the case 531 facing the contact surface 532*a*, thereby being held movable up and down, as described above. The case 531 has a plurality of depressions on the side having the contact surfaces 531*a*, with which the projections 533*c* and 533*d* of the stopper 533 are configured to be slidably in contact. The depressions provide spaces 531*c* and 531*d*. The depressions have sloping surfaces 531*e* and 531*f*, respectively, on lower sides of the inner walls thereof.

Tips 533*g* and 533*h* of the projections 533*c* and 533*d* face the spaces 531*c* and 531*d*, respectively, provided in the case 531. The projections 533*c* and 533*d* have on lower sides thereof sloping surfaces 533*e* and 533*f* angled so as to be substantially parallel to the sloping surfaces 531*e* and 531*f*, respectively, of the depressions providing the spaces 531*c* and 531*d* in the case 531. The projections 533*c* and 533*d* of the stopper 533 and the spaces 531*c* and 531*d* provided by the depressions in the case 531 in combination serve as a movement mechanism according to the present invention.

Now, a case will be described where the trailing-end regulator 53 is moved in the sheet conveyance direction by pushing the case 531 in the direction of the arrow 541 shown in FIG. 2B, without unlocking the stopper 533 using the release lever 535.

Figure 6A:
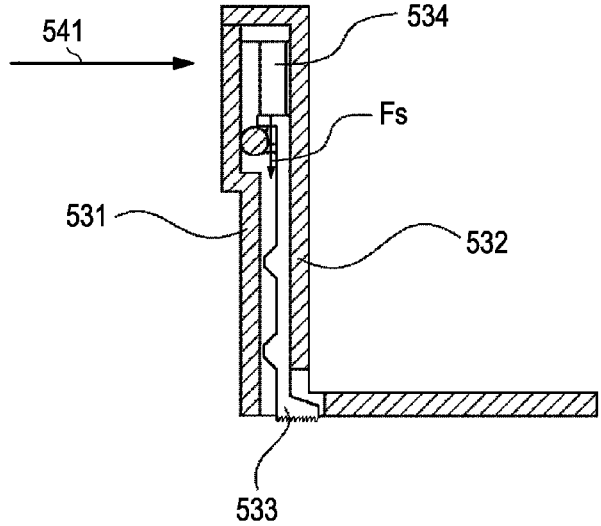
FIGS. 6A and 6B are cross-sectional views of a known trailing-end regulator.
Figure 6B:
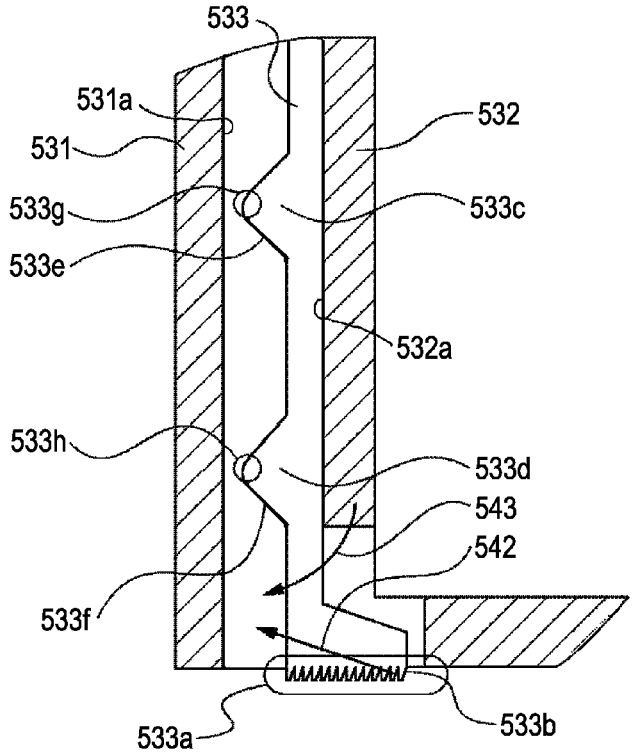
Figure 7:
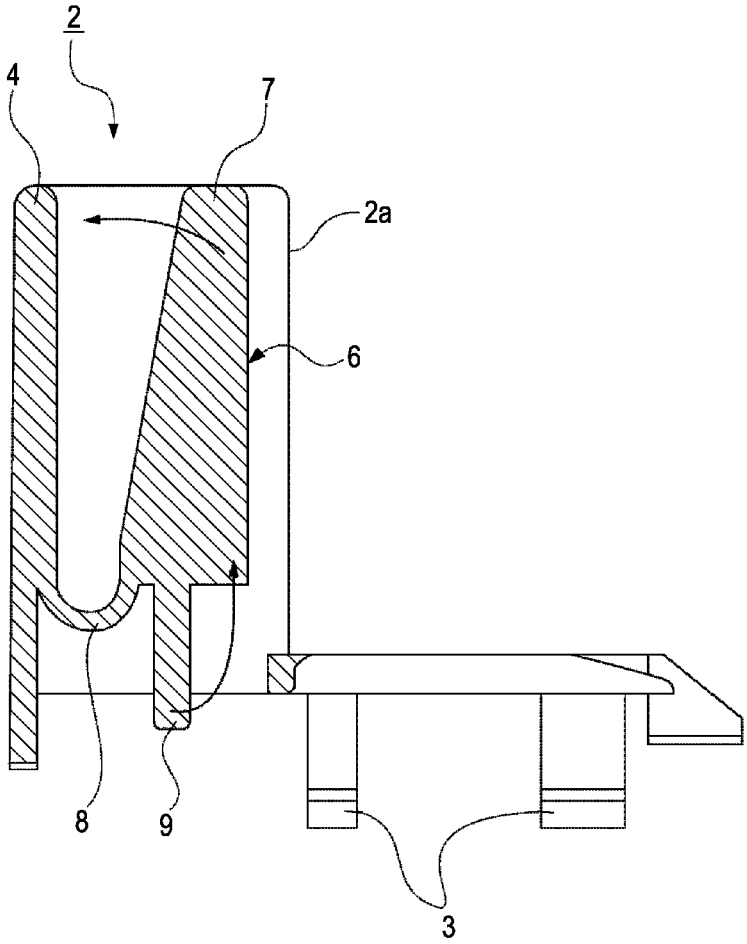
FIG. 7 is a cross-sectional view of another known trailing-end regulator.

To begin with, referring to FIGS. 6A and 6B, in an example where no spaces corresponding to the spaces 531*c* and 531*d* are provided in the case 531 will be clarified. Here, elements the same as or similar to those in the embodiment of the present invention are denoted by the same reference numerals as in the embodiment, and detailed description thereof are omitted.

When the trailing-end regulator 53 is moved in the sheet conveyance direction by pushing the case 531 in the direction of the arrow 541 shown in FIG. 6A, the teeth of the rack 533*a* and the rack 151 come into contact with each other at their sloping surfaces. Therefore, the stopper 533 moves upward against the resilience of the spring 534, with the teeth of the rack 533*a* of the stopper 533 being guided along the sloping surfaces of the teeth of the rack 151. Further, the teeth of the rack 533*a* sequentially climb over the teeth of the rack 151. In this manner, the trailing-end regulator 53 moves. When the case 531 is pushed in the direction of the arrow 541 shown in FIG. 6A, the tips 533*g* and 533*h* of the projections 533*c* and 533*d* of the stopper 533 come into contact with the contact surface 531*a* of the case 531. The case 531 and the stopper 533 of this known example are not in surface contact with each other. In such a case, the projections 533*c* and 533*d* facilitate the up-and-down sliding movement of the stopper 533.

Practically, however, when the case 531 is pushed in the direction of the arrow 541 shown in FIG. 6A, referring now to FIG. 6B, a reactive force is produced in a direction indicated by an arrow 542. This produces another force acting to turn the stopper 533 about the tip 533*h* in a direction of an arrow 543. Consequently, a biting force with which the rack 533*a* bites the rack 151 when the stopper 533 is pushed so as to turn in the direction of the arrow 543 is produced besides a frictional force produced by the sliding between the teeth of the rack 533*a* and the rack 151. Therefore, a pushing force enabling the rack 533*a* of the stopper 533 to climb over the rack 151 of the cassette frame 10*a* needs to be larger than the sum of the frictional force and the biting force. Moreover, the larger the pushing force becomes, the harder the racks 533*a* and 151 bite each other, requiring a much larger pushing force.

In view of the above, the embodiment of the present invention provides the following solution.

Figure 5A:
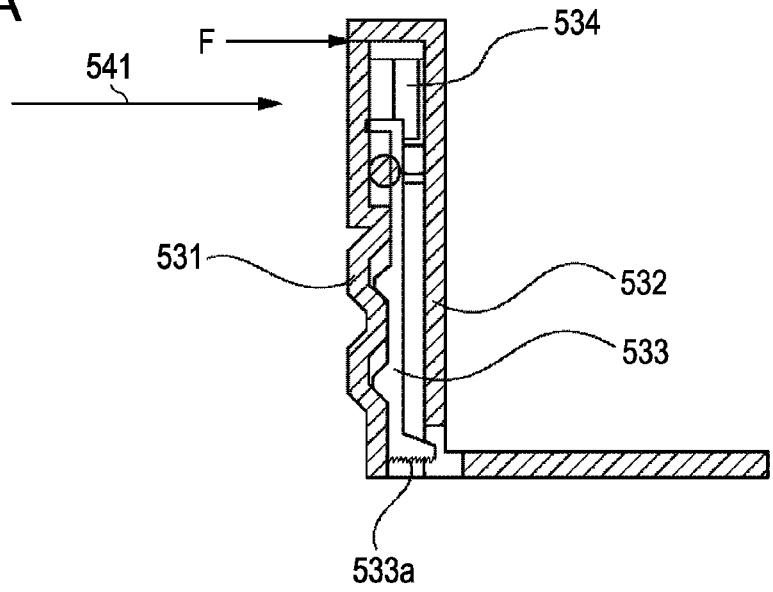
FIGS. 5A and 5B show a behavior of a stopper and a force applied to the stopper, respectively, the stopper being included in the trailing-end regulator shown in FIGS. 3A and 3B.
Figure 5B:
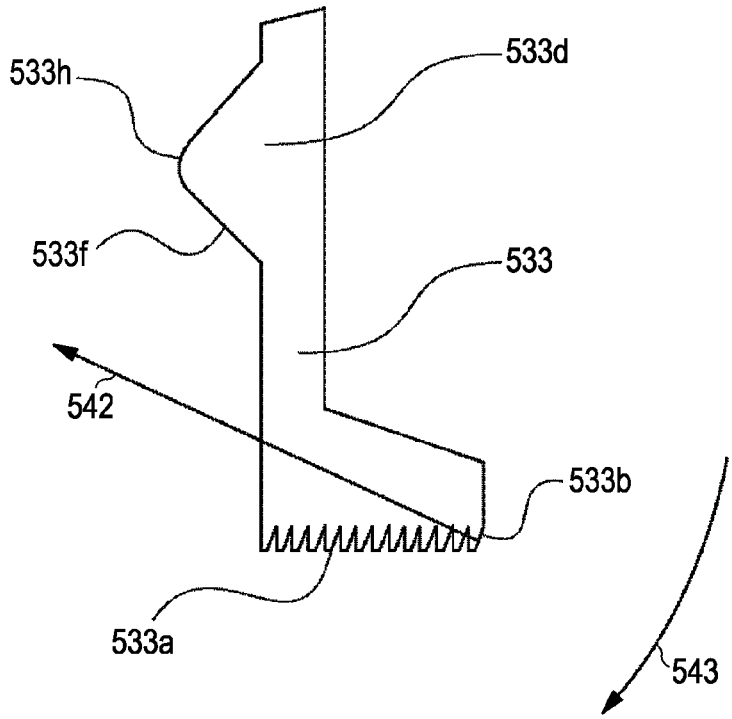

Referring to FIG. 5A, when the rear side of the case 531 is pushed in the direction of the arrow 541, the trailing-end regulator 53 receives on the entirety thereof a force acting in the direction of the arrow 541 and starts moving. In this state, referring to FIG. 5B, the rack 533*a* of the stopper 533 meshing with the rack 151 of the cassette frame 10*a* receives a force acting in the direction of the arrow 542 perpendicular to the surface 533*b* of each tooth of the rack 533*a*. When the trailing-end regulator 53 moves in the direction of the arrow 541, the rack 533*a* of the stopper 533 that is in contact with the rack 151 of the sheet feeding cassette 10 slides along and climbs over the rack 151, producing a frictional force therebetween.

In the embodiment, the spaces 531*c* and 531*d* are provided in the case 531. Specifically, even if a force in the direction of the arrow 542 is applied from the rack 151 of the cassette frame 10*a* to the rack 533*a* of the stopper 533, the projection 533*d* of the stopper 533 slides into the space 531*d*. This prevents the stopper 533 from turning about the tip 533*h* in the direction of the arrow 543. Accordingly, no biting force is produced.

Therefore, the pushing force enabling the rack 533*a* of the stopper 533 to climb over the rack 151 of the cassette frame 10*a* only needs to be larger than the frictional force produced by the sliding between the rack 533*a* and the rack 151.

Referring to FIG. 5A, the stopper 533 is configured such that the sloping surfaces 533*e* and 533*f* thereof are slidably in contact with the sloping surfaces 531*e* and 531*f* of the case 531 when the tips 533*g* and 533*h* of the projections 533*c* and 533*d* slide into the spaces 531*c* and 531*d*, respectively, provided in the case 531. Thus, a force acting in a direction in which the stopper 533 is moved away from the rack 151 of the sheet feeding cassette 10, i.e., a force with which the stopper 533 is lifted up, is produced. Such a configuration reduces the frictional force produced by the sliding between the rack 533*a* and the rack 151. Accordingly, the pushing force enabling the rack 533*a* of the stopper 533 to climb over the rack 151 of the cassette frame 10*a* can be made much smaller.

To summarize, with the trailing-end regulator 53 having the configuration according to the above embodiment, the trailing-end regulator 53 can be moved in the sheet conveyance direction with a small physical force because of the movement mechanism that works effectively, even without pinching and turning the release lever 535. Thus, the operability of the trailing-end regulator can be improved dramatically.

In the above embodiment, the stopper 533 has the projections 533*c* and 533*d* and the case 531 has the depressions. Alternatively, the stopper may have depressions and the case may have projections. Further, in the above embodiment, both the projections 533*c* and 533*d* and the depressions have the sloping surfaces for sliding movement. Alternatively, either the projections or the depressions may have sloping surfaces.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims the benefit of Japanese Patent Application No. 2008-171715 filed Jun. 30, 2008, which is hereby incorporated by reference herein in its entirety.

What is claimed is:

1. A sheet feeding apparatus comprising:

a housing unit in which sheets are stacked;

a pickup roller which feeds the sheet stacked in the housing unit in a conveyance direction;

a regulator provided in the housing unit including a regulator body having a surface at which trailing-ends of the sheets in the housing unit are regulated, the regulator is moved in the conveyance direction and in an opposite direction to the conveyance direction;

a stopper provided in the regulator body of the regulator includes a rack having a plurality of stopper teeth;

a retainer in the housing unit includes a rack having a plurality of retainer teeth, the regulator is locked to the housing unit by the stopper teeth engaged with the retainer teeth;

a lock-releasing mechanism including a release lever and configured to release an engagement of the retainer with the stopper, and when the release lever is pushed in the opposite direction to the conveyance direction, the stopper is moved in a release direction away from the retainer to disengage the stopper and the retainer teeth; and a movement mechanism provided in the regulator body including a depression provided in one of the stopper and the regulator body and a projection provided on the other of the stopper and a guide surface, and at least one of a surface of the depression and a surface of the projection that are in contact with each other is sloped, wherein when the regulator body is pushed in the conveyance direction, one of the projection and the depression is moved along the other and the stopper is moved in the release direction away from the retainer to disengage the teeth of the rack of the stopper and the retainer.

2. The sheet feeding apparatus according to claim 1, wherein the release lever of the lock-releasing mechanism releases the mesh.

3. The sheet feeding apparatus according to claim 2, wherein the teeth of the rack of the stopper and the teeth of the rack of the retainer each have vertical surfaces and sloping surfaces, and wherein, to make the regulator movable in such a direction that the teeth of the rack of the stopper and the teeth of the rack of the retainer are pushed against each other at the vertical surfaces, the meshing between the teeth is released by using the release lever.

4. The sheet feeding apparatus according to claim 3, wherein the regulator becomes movable in the conveyance direction with an aid of the movement mechanism, and in the opposite direction of the conveyance direction with an operation of the release lever.

5. An image forming apparatus comprising:

a sheet feeding apparatus configured to feed a sheet; and an image forming unit configured to form an image on the sheet, wherein the sheet feeding apparatus includes a housing unit in which sheets are stacked;

a pickup roller which feeds the sheet stacked in the housing unit in a conveyance direction;

a regulator provided in the housing unit including a regulator body having a surface at which trailing-ends of the sheets in the housing unit are regulated, the regulator is moved in the conveyance direction and in an opposite direction to the conveyance direction;

a stopper provided in the body of the regulator includes a rack having a plurality of stopper teeth;

a retainer in the housing unit includes a rack having a plurality of retainer teeth, the regulator is locked to the housing unit by the stopper teeth engaged with the retainer teeth;

a lock-releasing mechanism including a release lever and configured to release an engagement of the retainer with the stopper, and when the release lever is pushed in the opposite direction to the conveyance direction, the stopper is moved in a release direction away from the retainer to disengage the teeth of the rack of the stopper and the retainer; and a movement mechanism provided in the regulator body including a depression provided in one of the stopper and the regulator body and a projection provided on the other of the stopper and a guide surface, and at least one of a surface of the depression and a surface of the projection that are in contact with each other is sloped, wherein when the regulator body is pushed in the conveyance direction, one of the projection and the depression is moved along the other and the stopper is moved in the release direction away from the retainer to disengage the teeth of the rack of the stopper and the retainer.

6. The image forming apparatus according to claim 5, wherein the release lever of the lock-releasing mechanism includes a lever to release the mesh.

7. The image forming apparatus according to claim 6, wherein the teeth of the rack of the stopper and the teeth of the rack of the retainer each have vertical surfaces and sloping surfaces, and wherein, to make the regulator movable in such a direction that the teeth of the rack of the stopper and the teeth of the rack of the retainer are pushed against each other at the vertical surfaces, the meshing between the teeth is released by using the release lever.

8. The image forming apparatus according to claim 7, wherein the regulator becomes movable in the conveyance direction with an aid of the movement mechanism, and in the opposite direction of the conveyance direction with an operation of the lever.

* * * * *